US006547247B2

(12) United States Patent
Hoyt et al.

(10) Patent No.: US 6,547,247 B2
(45) Date of Patent: Apr. 15, 2003

(54) PLAYING CARDS AND METHOD FOR PLAYING CARD GAMES THEREWITH

(76) Inventors: David L. Hoyt, 10 E. Elm, #308, Chicago, IL (US) 60611; Stephen M. Flaherty, 3723 W. 114th Pl., Chicago, IL (US) 60655

( * ) Notice: Subject to any disclaimer, the term of this patent is extended or adjusted under 35 U.S.C. 154(b) by 0 days.

(21) Appl. No.: 09/826,637

(22) Filed: Apr. 5, 2001

(65) Prior Publication Data

US 2001/0035608 A1 Nov. 1, 2001

Related U.S. Application Data

(60) Provisional application No. 60/195,600, filed on Apr. 6, 2000.

(51) Int. Cl.[7] ..... A63F 1/00

(52) U.S. Cl. ..... 273/292; 273/274; 273/236; 273/293; 273/304

(58) Field of Search ..... 273/292, 273, 273/271, 293, 304, 383, 384, 236, 274

(56) References Cited

U.S. PATENT DOCUMENTS

D291,330 S * 8/1987 Raheb ..... D21/45
4,807,885 A * 2/1989 Chamblee et al. ..... 273/292
5,076,588 A * 12/1991 Minh ..... 273/249
5,451,062 A * 9/1995 Malone ..... 273/292
5,992,854 A * 11/1999 Flory et al. ..... 273/138.1
6,149,155 A * 11/2000 Hoyt et al. ..... 273/292
6,220,959 B1 * 4/2001 Holmes et al. ..... 273/292
6,248,149 B1 * 6/2001 Massey et al. ..... 175/374
6,308,955 B1 * 10/2001 Slatter ..... 273/243

* cited by examiner

*Primary Examiner*—Benjamin H. Layno
*Assistant Examiner*—D Collins
(74) *Attorney, Agent, or Firm*—Baniak Pine & Gannon

(57) ABSTRACT

A novel card game is disclosed utilizing a standard deck of playing cards and played by combining the rules of tic-tac-toe and twenty-one or poker. The player places the cards at certain locations in order to accumulate combinations of twenty-one or in order to accumulate the best poker hands. Also disclosed are novel decks of game playing cards containing playing cards. One novel deck consists of groups of cards, each containing the numeric values of one through ten. The other novel deck contains 37 or 38 novel cards, each containing a numeric value one through 36, or a zero or a double zero, along with a color indication of red, black or green.

11 Claims, 2 Drawing Sheets

PLAYING CARDS AND METHOD FOR PLAYING CARD GAMES THEREWITH

This application claims the benefit of Provisional Application No. 60/195,600, filed Apr. 6, 2000.

TECHNICAL FIELD OF THE INVENTION

The present invention relates to novel card games or gambling games that can be played with a standard deck of cards or with a novel deck of playing cards, more specifically the present invention relates to a novel card game utilizing the combination of the well known tic-tac-toe game, along with the rules of blackjack (otherwise known as twenty-one), or the rules of poker. In the novel game, nine playing cards are dealt to a player, one at a time from a standard deck of 52 playing cards, and the player must decide as each card is dealt where to place the card on a tic-tac-toe (3 by 3 array) board, in order to obtain the sum of 21 (when adding up three cards), either across, down or on a diagonal. The player attempts to create as many 21 totals as possible. In the novel game of poker, the cards are also placed on the board, but the player places the cards in the optimal position to obtain the best poker hand or hands.

An alternative embodiment of the present invention relates to a novel deck of playing cards made up of approximately 60 cards. The novel deck comprises six groups of ten cards, each card having a numeric value of between one and ten (i.e., six cards having the number five, six cards having the number ten, etc.). These novel cards, unlike standard cards, do not contain a suit indication, such as Spades, Hearts, Diamonds or Clubs.

Another alternative embodiment of the present invention is a novel deck of playing cards contains either 37 or 38 cards. Each playing card corresponds to a number (1 through 36, 0 and 00), and a color (black, red or green), found on a standard wheel used in a game of roulette. The novel cards may also contain other information, such as whether the card number is odd or even, and whether the number on the card pertains to the first-third of numbers, second-third, or third-third.

BACKGROUND OF THE INVENTION

Playing cards have been in existence for many years. Although there are many types of playing cards that are played in many different types of games, the most common type of playing cards consists of 52 cards, divided out into four different suits (namely Spades, Hearts, Diamonds and Clubs) which are printed or indicated on one side or on the face of each card. In the standard deck, each of the four suits of cards consists of 13 cards, numbered either two through ten, or lettered A (Ace), K (King), Q (Queen), or J (Jack), which is also printed or indicated on the face of each card. Each card will thus contain on its face a suit indication along with a number or letter indication. The King, Queen, and Jack usually also include some sort of design on the face of the card, and may be referred to as picture cards.

In some cases, the 52 card standard playing deck also contains a number of extra cards, sometimes referred to as jokers, that may have some use or meaning depending on the particular game being played with the deck. For example, if a card game includes the jokers, then if a player receives a joker in his "hand" he may use it as any card in the deck. If the player has the ten, jack, queen and king of Spades, along with a joker, the player would use the joker as an Ace of Spades. The player will then have a Royal Flush (ten through Ace of Spades).

Many different games can be played using a standard deck of playing cards. The game being played with the standard deck of cards may include other items, such as game boards, chips, etc., or the game being played may only need the playing card deck itself. In most of the games played using a standard deck of cards, a value is assigned to each card. The value may differ for different games.

Usually, the card value begins with the number two card as the lowest value and increases as the numbers increase through ten, followed in order of increasing value with the Jack, Queen, King and Ace. In some games the Ace may have a lower value than the two, and in games where a particular card is determined to be wild, or have any value, that card may have the greatest value of all. For example, in card games where deuces, or twos, are wild, the player holding a playing card containing a two can use that two as any other card, such that a nine and a two would be the equivalent of two nines.

Further, the four different suits indicated on the cards may have a particular value depending on the game. Under game rules where one suit, i.e. Spades, has more value than another suit, i.e. Hearts, the seven of Spades may have more value than the seven of Hearts.

It is easy to visualize that using the different card quantity and suit values, many different games can be played. In certain games, it is the combination of cards that one player obtains that determines whether or not that player has defeated the other player or players. Usually, the more difficult the combination is to obtain, the more value the combination has, and the player who obtains the more difficult combination (also taking into account the value of the cards) wins the game.

For instance in the game of Poker, each player may ultimately receive five cards. The player who obtains three cards having similar numbers on their face, i.e. the four of Hearts, four of Diamonds and four of Clubs, will defeat the player having only two cards with the same numerical value, i.e. the King of Spades and the King of Hearts. However, the player with five cards that all contain Clubs, commonly known as a flush, will defeat the player with the same three of a kind described above.

In many instances, a standard deck of playing cards is used to create gaming machines. In these gaming machines players insert coins and play certain card games, such as poker, using an imitation of standard playing cards on a video screen, in an attempt to win back more money than they originally inserted into the machine.

Another form of gambling using playing cards utilizes tables, otherwise known as table games. A table uses a table and a dealer, with the players sitting or standing around the table. The players place their bets on the table and the dealer deals the cards to each player. The number of cards dealt, or whether the cards are dealt face up or face down, will depend on the particular table game being played.

Further, an imitation or depiction of a standard playing card is used in many handheld electronic games, such as poker and blackjack, and in many computer games and Internet games. Using a handheld electronic game or a computer terminal that may or may not be connected to the Internet, a player receives the imitation playing cards and plays a card game either against the computer or against other players. Further, many of these games can be played on the computer in combination with gambling.

Also, there are many game shows that are broadcasted on television that use a deck of playing cards in the game play, in which the cards are usually enlarged or shown on a video screen or monitor for easy viewing. In these television game shows, the participants play the card game for prizes or money, usually against each other, with an individual acting as a host overseeing the action.

Also, there are lottery tickets that players purchase and play by "scratching off" an opaque layer to see if they have won money and prizes. The opaque layer prevents the player from knowing the results of the lottery ticket prior to purchasing and scratching off the layer. In some of these lottery tickets, playing cards are used under the opaque layer and the player may need to match a number of similar cards in order to win the prizes or money.

BRIEF SUMMARY OF THE INVENTION

In the present invention, a novel board game and/or gambling game that can be played with a standard deck of playing cards utilizing the combination of tic-tac-toe with the rules of blackjack or twenty-one. Nine cards are dealt, one at a time, from a standard deck of playing cards (52 cards having 13 cards per each of four suits). The player must decide, as each card is dealt, where to place the card on an enlarged tic-tac-toe board. The object is to obtain a sum of twenty-one either across, down or on the diagonals.

An object of the present invention is to provide a method for playing the game of blackjack in which nine standard playing cards are dealt to the player, and the player places the cards on an exaggerated (in size) tic-tac-toe board in an attempt to obtain totals of 21 when adding three cards (either across, down or diagonal). The player positions the cards such that as many totals of 21 can be obtained.

Another object of the present invention is to provide a method for playing the game of poker in which nine standard playing cards are dealt to the player, and the player places the cards on an exaggerated (in size) tic-tac-toe board in an attempt to obtain the highest value poker hand using three cards (either across, down or diagonal). The player positions the cards such that each set is a separate poker hand.

Another aspect of the present invention relates to a deck of playing cards made up of 60 individual cards, divided into six groups of ten cards per group. Each card of each group has a numeric value of between one and ten (i.e., six cards having the number five, six cards having the number ten, etc.) These cards do not necessarily need a suit indication (club, spade, diamond or heart) as found on cards from a standard playing deck of cards. Other combinations of numeric values and group numbers can be used, such as ten groups of cards each card containing the numeric value of between one and seven.

Another aspect of the present invention relates to a novel deck of playing cards containing novel cards, each card corresponding to a number (one through 36, 0 or 00), or a color (black, red or green). This information is similar to some of the information found on a standard roulette wheel and table board. If there is only one "zero" card, then the deck contains 37 cards; if there is a "double-zero" card, the deck will contains 38 cards.

DETAILED DESCRIPTION OF THE INVENTION

Figure 1:
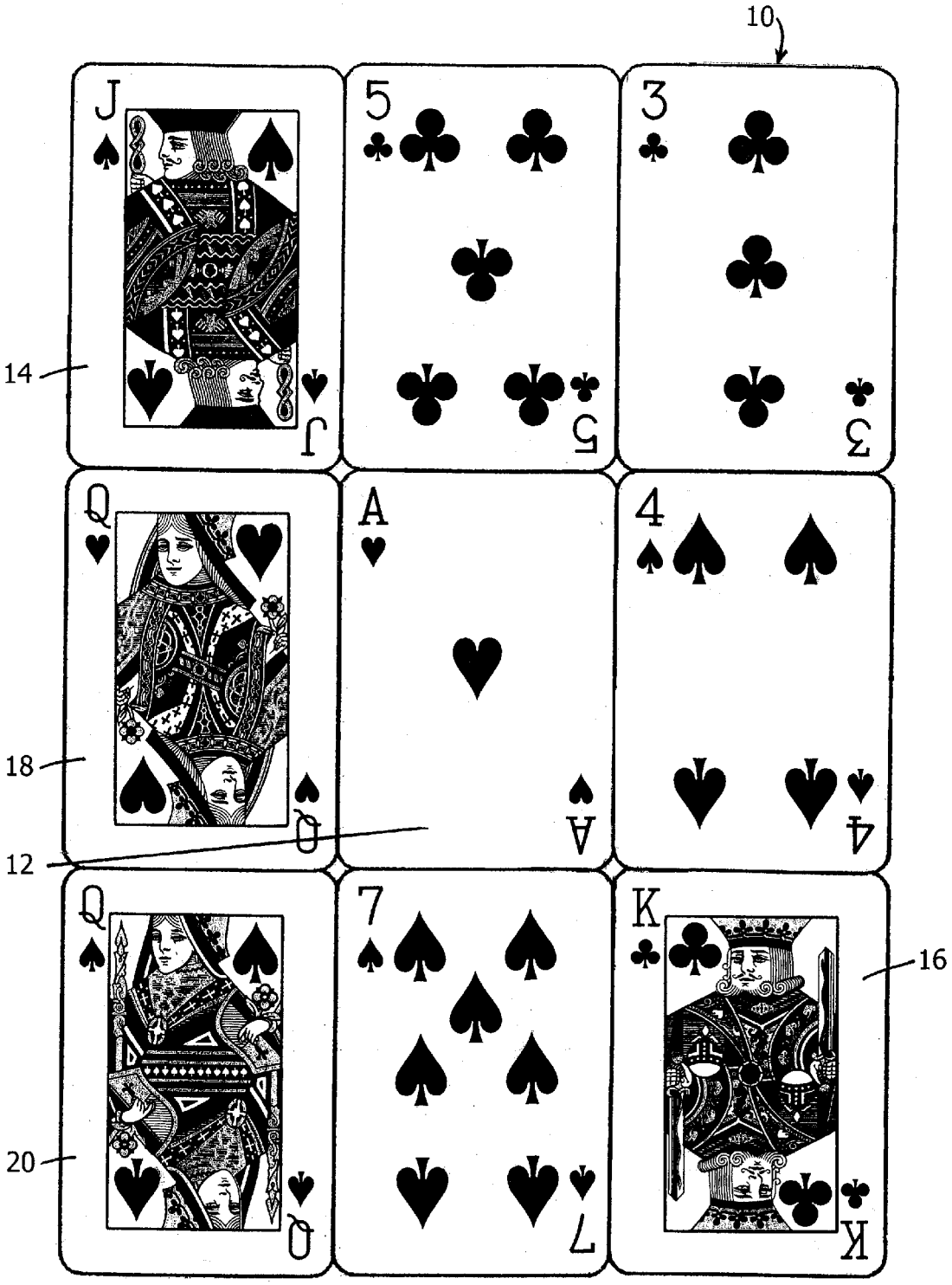
FIG. 1 is a front view of nine playing cards located on the playing board after playing a version of the game embodying the present invention.

The present invention relates to a novel board game and/or gambling game and method that can be played with a standard deck of playing cards utilizing the combination of the well known game of tic-tac-toe, along with the rules of blackjack (otherwise known as twenty-one). The object of the game is to obtain a sum of twenty-one, or as many twenty-ones as possible, across, down or on the diagonals, as nine cards are dealt, one at a time, from a standard deck of playing cards (52 cards having 13 cards per each of four suits). FIG. 1 shows the final layout of the cards 10 in the tic-tac-toe arrangement in accordance with the present invention.

At the beginning of the game, an empty board (not shown) containing a three by three array, similar to a tic-tac-toe board, is laid out. The game can be played without a board, and instead just approximate where the nine different positions are located.

A first card 12 is dealt to a player, and the player must decide which place on the board (of the nine possibilities) the card should be placed. In the example of FIG. 1 the player was dealt an Ace of Hearts as a first card 12. The player decided to put the first card 12 in the center position.

Once the player places the first card 12, a second card 14 is dealt to the player. In FIG. 1 a Jack of Spades was dealt as the second card 14. Again, the player must decide which position, of the eight remaining positions, to place the card (upper left corner). After each card is placed in a position, another card is dealt, and the player must decide in which of the remaining tic-tac-toe locations the dealt card must be placed.

When the game is complete and all nine cards have been dealt and placed, the nine cards will be laid out in three rows of three cards per row. By adding up the three card combinations, across, down and diagonally, (eight combinations in all) the player can calculate how many twenty-ones he has created. In the example shown in FIG. 1, the only twenty-one created begins at the upper left card 14 (Jack of Spades) and moves diagonally down across the middle 12 (Ace of Hearts) to the lower right card 16 (King of Clubs). The other combinations have totals that are either greater than or less than twenty-one.

The board will be sufficient size to be able to accommodate standard playing cards, however, a smaller board can be used for smaller cards. Further, as described above, a board is not necessary as the cards can be placed on a table in the correct location.

The novel board or gambling game utilizing a tic-tac-toe format could also be played as a poker game, instead of twenty-one as described above. In this alternative embodiment, the player places the cards as dealt onto the game board in an attempt to create the best poker hands using the three card combinations across, down and diagonal.

For example, if the player was initially dealt an Ace of spades, the player may place the Ace in the middle of the board. If the second card was an Ace of Hearts, the player may place that second Ace in the upper-middle position. If the third card dealt was the two of Hearts, the player may position the card in the upper-left location such that if another Heart is dealt, it can be placed in the upper-right position to complete the flush, if however another Ace is dealt, it can be placed in the lower-middle position for triple Aces. There are many different strategies that a player can use to play this tic-tac-toe type poker game. As described above, the player does not stop until all of the nine positions are filled. The player attempts to obtain as many winning poker hands as possible.

If the player placed the nine cards that he was dealt into the locations shown in FIG. 1, then the best hand the player has obtained the hand containing the Jack of Spades 14, the Queen of Hearts 18, and the Queen of Spades 20, otherwise known as a pair of Queens.

The present invention, both the blackjack and poker embodiments, can be played on a handheld video device or a computer screen (not shown). A reproduction of the playing cards can be dealt or displayed, and the player can decide which location in which to place the card. The software for such a game could be distributed by either CD-ROM (or another medium), or downloaded from the Internet. Further, the game could be played online, either with gambling or without.

This novel game play can also be applied to the gaming industry, allowing a player to insert coins, or otherwise bet, prior to or during the game play. The various payouts would be determined based on the amount gambled, and the number of twenty-ones attained (or possible based on the fewer cards to reach a twenty-one).

The novel game play may also be utilized in a television game show format. The contestants are dealt a card from the deck and place that card in one of the nine locations. The cards can be displayed to the contestants and the audience by using large easily readable cards, or monitors that display the card when that location is selected.

Both of the above-described games can be played with a standard, nine-position tic-tac-toe type board or playing field. However, these games can also be played on a board or field that contains four or five (or more) across or down. In an alternative embodiment, where a five by five position board is used (not shown), a game similar to stud poker can be played with five poker hands across, five poker hands down, and two diagonal hands.

Figure 2:
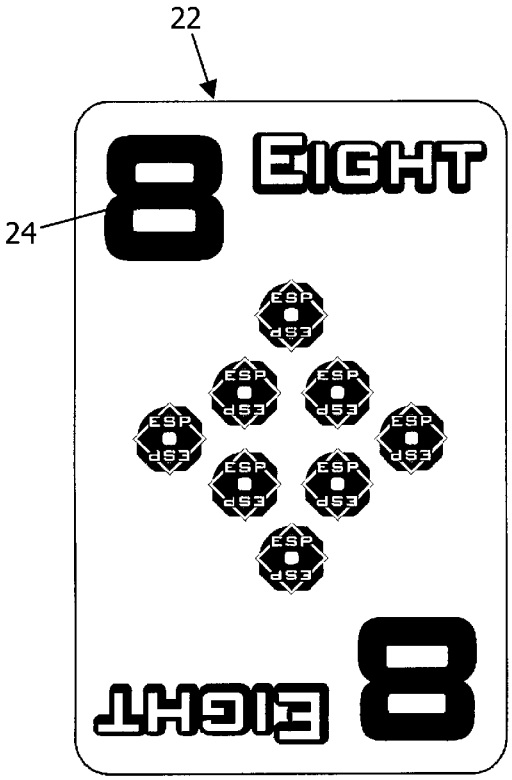
FIG. 2 is a front view of a single playing card from an alternative novel deck of playing cards embodying the to present invention.

An alternative embodiment of the present invention relates to a novel deck of playing cards made up of 60 individual cards, divided into six groups of ten cards per group. FIG. 2 shows a card 22 in accordance with the alternative embodiment of the present invention. Each card 22 of each group has a numeric value 24 between one and ten (i.e., six cards having the number five, six cards having the number ten, etc.) The card 22 shown in FIG. 2 has the numeric value of eight. These cards do not necessarily need a suit indication (Club, Spade, Diamond or Heart) as found on cards from a standard playing deck of cards. Of course, other combinations of numeric values and group numbers can be used, such as ten groups of cards each card containing the numeric value of between one and seven.

In using this deck to play a game, after the novel deck is shuffled and the cards are in a random order, the dealer deals a card up with the numeric value of that card showing. The player then attempts to guess whether or not the next card to be dealt will have a numeric value that is higher or lower (or possibly the same value) than the initial card. If the player guesses correctly, he may choose to continue. Each guess is based on whether the player believes that the next card dealt will be higher or lower than the previously dealt card. The winner of the game is the player that can predict the largest number correctly in a row.

These novel cards can also be used in the gaming industry as table games (i.e., a dealer deals cards to a player or players sitting around the table), for video gaming machines, on handheld video devices or computers (either CD-ROM, or downloaded from the Internet) for game play. In these instances, the payout may be determined based on the types of correct guesses (high-low, numeric value), the number of correct guesses (possibly in a row), and the amount initially wagered.

Figure 3:
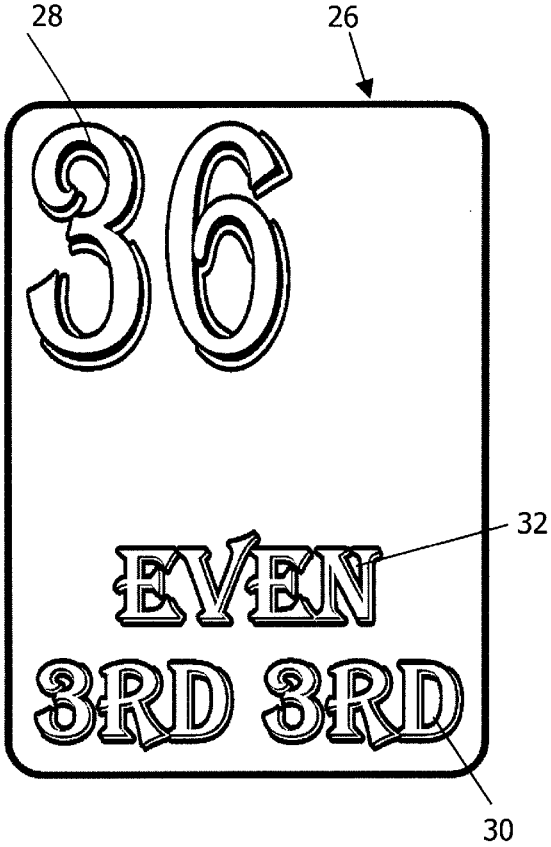
FIG. 3 is a front view of a single playing card from an alternative novel deck of playing cards embodying the present invention.

FIG. 3 shows another card 26 from another alternative embodiment of the present invention. The novel deck of playing cards contains a number of these novel cards 26. In the preferred embodiment, the novel deck contains either 37 or 38 cards 26. Each card 26 has a number 28 on its face. The number in the preferred embodiment is between one and 36, or 0 or 00. Each card 26 contains an indication of color on its face (not shown). The colors on the cards 26 in the preferred embodiment are black, red or green (based on the number 28). In the preferred embodiment, these cards 26 also contain other information, including whether the card is in the group 30 of cards labeled first-third (cards having numbers one through 12), second-third (cards having numbers 13 through 24), or third-third (cards having numbers 25 through 36). The 0 and 00 cards do not have such a group 30 indication. In the preferred embodiment, the cards also have an indication 32 that shows whether the card is even or odd (based on the number 28). These cards contain information similar to the information found on a roulette table.

If there is only one zero card, then the preferred deck contains 37 cards; if there is also a double-zero card, the preferred deck contains 38 cards. For example, one card would contain the number seven, the indication of odd, and the color black, while another card would contain the number 14, an indication of even, and the color red. With this novel deck of cards, a roulette-type game (or gambling game) could be played. Instead of rolling the ball on a roulette wheel to determine the winner of the game, the dealer shuffles the deck and turns over a card; the odds are similar to those in roulette. However, in alternative game play, if the deck is not shuffled after each deal, the odds of a particular card being turned up changes after each deal.

Of course there are other games that can be played using the roulette deck. A player may try to predict whether the next card to be turned up will be higher or lower than the previous card, or whether the next card turned up will be red, black, green, odd, even, first-third, second-third, or third-third, etc. Each guess will be worth a different value depending on the odds. As long as a player guesses correctly, he can continue to guess.

Similar to the first set of novel cards, these roulette cards can also be utilized in the gaming industry as table games, video gaming machines, handheld video devices or on computers (either CD-ROM, or downloaded from the Internet) for game play. In these instances, the payout is determined based on the types of correct guesses (high-low, numeric value, odd-even, color, etc.), the number of correct guesses (possibly in a row), and the amount initially wagered.

Further, the tic-tac-toe blackjack, tic-tac-toe poker, and novel card embodiments can be utilized as lottery tickets, where the player scratches off the opaque layer in order to reveal the playing cards underneath. In tic-tac-toe blackjack, if the player's combination of numbers equals 21, the player wins. The more combinations that add to 21, the more times the player wins. The same holds true for the poker embodiment. A certain hand could decide the winner (pair of jacks or better). The player can win multiple hands.

The foregoing detailed description of the invention is intended to be illustrative and not intended to limit the scope of the invention. Changes and modifications are possible with respect to the foregoing description, and it is understood that the invention may be practiced otherwise than that specifically described herein and still be within the scope of the claims.

What is claimed is:

1. A method of playing a card game wherein the object is to accumulate three cards whose values add up to 21, comprising the steps of:

a) dealing a playing card from a deck of playing cards to a player;

b) placing said playing card in one of nine locations, said one of nine locations being determined by a three by three array;

c) dealing another playing card to said player;

d) placing said another playing card into a remaining location of said nine locations, said remaining location being decided by the chance that the addition of the values of the playing cards in the rows, columns or diagonals once the three by three array is completed, will add up to 21;

e) repeating steps c) and d) until there are no locations without playing cards.

2. The method of playing a card game in claim 1, further comprising the steps of:

f) adding up all of the playing cards in a particular row;

g) adding up all of the playing cards in a particular column;

h) adding up all of the playing cards in a particular diagonal.

3. A deck of playing cards comprising a multiple number of playing cards, each card having a front side of the card and a back side of the card, said back side either containing a design or not containing a design, such that each of the multiple number of cards contains a back side which is similar to each of the other multiple number of cards, such that said multiple number of cards cannot be distinguished from the others by observing the back side of the card, said front side of each of said multiple number of playing cards contains a number, an indication of color, an indication of odd or even, and an indication of group, wherein said number is between one and 36.

4. The deck of playing cards of claim 3, wherein said multiple number of playing cards is 36.

5. The deck of playing cards of claim 4, wherein said indication of odd or even is related to said number.

6. The deck of playing cards of claim 4 wherein said indication of color is black or red.

7. The deck of playing cards of claim 4 wherein said indication of group is either first-third, second-third, or third-third.

8. The deck of playing cards of claim 3, further comprising a playing card wherein the number is 0, the indication of color is green, and there is no indication of odd or even or group.

9. The deck of playing cards of claim 8, further comprising a playing card wherein the number is 00, the indication of color is green, and there is no indication of odd or even or group.

10. The method of playing a card game in claim 2, further comprising the steps of:

i) determining from step f, how many rows add up to 21;

j) determining from step g, how many columns add up to 21;

k) determining from step h, how many diagonals add up to 21; and l) adding up the total number of 21s from steps i, j and k.

11. The method of playing a card game in claim 10, further comprising the step of:

m) determining a payout based on the total number of 21s from step 1.

* * * * *